US010131059B2

(12) United States Patent
Ikoma

(10) Patent No.: US 10,131,059 B2
(45) Date of Patent: Nov. 20, 2018

(54) FOLDING KNIFE WITH SAFETY MEMBER

(71) Applicant: GB II Corporation, Tualatin, OR (US)

(72) Inventor: Flavio Yuji Ikoma, Sao Paulo (BR)

(73) Assignee: GB II Corporation, Tualatin, OR (US)

( * ) Notice: Subject to any disclaimer, the term of this patent is extended or adjusted under 35 U.S.C. 154(b) by 196 days.

(21) Appl. No.: 14/929,024

(22) Filed: Oct. 30, 2015

(65) Prior Publication Data

US 2016/0121493 A1 May 5, 2016

Related U.S. Application Data

(60) Provisional application No. 62/073,851, filed on Oct. 31, 2014.

(51) Int. Cl.
*B26B 1/04* (2006.01)

(52) U.S. Cl.
CPC ..... *B26B 1/048* (2013.01); *B26B 1/042* (2013.01); *B26B 1/046* (2013.01)

(58) Field of Classification Search
CPC ..... B26B 1/04–1/048
USPC ..... 30/153, 155–161
See application file for complete search history.

(56) References Cited

U.S. PATENT DOCUMENTS 462,141 A * 10/1891 Kruschke ..... B26B 1/046 30/159
2,530,236 A * 11/1950 Erickson ..... B26B 1/046 30/159
4,120,088 A * 10/1978 Phelps ..... B26B 1/046 30/160
4,170,061 A * 10/1979 Henry ..... B26B 1/046 30/160
4,404,748 A * 9/1983 Wiethoff ..... B26B 1/046 30/161
4,439,922 A * 4/1984 Sassano ..... B26B 1/046 30/161
4,535,539 A * 8/1985 Friedman ..... B26B 1/046 30/159

(Continued)

FOREIGN PATENT DOCUMENTS

DE 29511947 U1 * 9/1995 ..... B26B 1/048
FR 980464 A * 5/1951 ..... B26B 1/048

(Continued)

*Primary Examiner* — Jason Daniel Prone
(74) *Attorney, Agent, or Firm* — Klarquist Sparkman, LLP

(57) ABSTRACT

Folding knife embodiments are disclosed herein comprising a blade operable to pivot relative to a handle, between an open position and a closed position, a blade-locking member disposed in the handle and being moveable in a first direction between an unlocked position and a locked position to retain the blade in at least one of the open or closed positions. The folding knife may further comprise a safety member mounted on the blade-locking member and being moveable relative thereto in a second direction between a release position and a safety position. Wherein when the safety member is in the safety position, the safety member and the blade-locking member are blocked from moving in the first direction, and wherein when the safety member is in the release position, the safety member and the blade-locking member can be moved in the first direction to move the blade-locking member to the unlocked position.

24 Claims, 6 Drawing Sheets

(56) References Cited

U.S. PATENT DOCUMENTS 4,541,175 A * 9/1985 Boyd ..... B26B 1/046 30/161
4,750,267 A * 6/1988 Boyd ..... B26B 1/046 30/161
4,926,554 A * 5/1990 Martin ..... B26B 1/048 30/161
5,111,581 A * 5/1992 Collins ..... B26B 1/046 30/160
5,293,690 A * 3/1994 Cassady ..... B26B 1/046 30/160
5,425,175 A * 6/1995 Rogers ..... B26B 1/046 30/161
5,596,808 A * 1/1997 Lake ..... B26B 1/044 30/160
5,615,484 A * 4/1997 Pittman ..... B26B 1/048 30/161
5,722,168 A * 3/1998 Huang ..... B23D 51/01 30/160
5,964,035 A * 10/1999 Poehlmann ..... B26B 1/046 30/161
5,966,816 A * 10/1999 Roberson ..... B26B 1/046 30/161
5,979,065 A * 11/1999 Hsu ..... B23D 51/01 30/161
6,134,788 A * 10/2000 Chen ..... B26B 1/046 30/161
6,145,202 A * 11/2000 Onion ..... B26B 1/046 30/160
6,256,888 B1 * 7/2001 Shuen ..... B26B 1/048 30/160
6,276,063 B1 * 8/2001 Chen ..... B26B 1/046 30/161
6,430,816 B2 * 8/2002 Neveux ..... B26B 1/046 30/161
6,434,831 B2 * 8/2002 Chen ..... B26B 1/046 30/161
6,446,341 B1 * 9/2002 Wang ..... B26B 1/046 30/161
6,834,432 B1 * 12/2004 Taylor, Jr. ..... B26B 1/044 30/160
7,165,329 B2 * 1/2007 Kao ..... B26B 1/044 30/160
7,231,718 B2 * 6/2007 Outen ..... B26B 1/046 30/161
7,243,430 B1 * 7/2007 Lerch ..... B26B 1/046 30/160
7,246,441 B1 * 7/2007 Collins ..... B26B 1/042 30/160
7,302,760 B2 * 12/2007 Lake ..... B26B 1/046 30/160
7,578,064 B2 * 8/2009 Busse ..... B26B 1/048 30/160
RE42,906 E * 11/2011 Onion ..... B26B 1/044 30/160
8,375,589 B2 * 2/2013 Bremer ..... B26B 1/046 30/160
8,646,184 B2 * 2/2014 Westerfield ..... B26B 1/046 30/161
8,707,564 B2 * 4/2014 Burch ..... B23D 51/01 30/160
9,387,595 B2 * 7/2016 Ikoma ..... B26B 1/042 30/161
2005/0097755 A1 * 5/2005 Galyean ..... B26B 1/046 30/161
2007/0180702 A1 * 8/2007 Hawk ..... B26B 1/048 30/161
2009/0193664 A1 * 8/2009 Galyean ..... B26B 1/046 30/161
2009/0260234 A1 * 10/2009 Lai ..... B23D 51/01 30/161
2009/0277015 A1 * 11/2009 Duey ..... B26B 1/046 30/160
2010/0325897 A1 * 12/2010 Chu ..... B26B 1/046 30/161
2013/0160300 A1 * 6/2013 Liu ..... B26B 1/048 30/161
2013/0283621 A1 * 10/2013 Snyder ..... B26B 1/046 30/161
2016/0075037 A1 * 3/2016 Ikoma ..... B26B 1/042 30/161
2017/0120461 A1 * 5/2017 Tom ..... B26B 1/048 30/161
2017/0246749 A1 * 8/2017 Karchon ..... B26B 1/048 30/161

FOREIGN PATENT DOCUMENTS

FR 2403874 A1 * 4/1979 ..... B26B 1/046
GB 188198 A * 11/1922 ..... B26B 1/048
GB 549428 A * 11/1942 ..... B26B 1/046
GB 1492208 A * 11/1977 ..... B26B 1/046
WO WO 2015122804 A2 * 8/2015 ..... B26B 1/04

* cited by examiner

FOLDING KNIFE WITH SAFETY MEMBER

CROSS REFERENCE TO RELATED APPLICATION

This application claims the benefit of U.S. Provisional Patent Application No. 62/073,851, filed Oct. 31, 2014, which is incorporated herein by reference.

FIELD

The present disclosure concerns embodiments of a folding knife having a safety member for preventing inadvertent opening and/or closing of a blade.

BACKGROUND

Folding knives can include a locking member configured to engage a portion of the blade when the blade is in the open position, thereby preventing the blade from folding closed during normal use. Some folding knives include a safety member to prevent the locking member from disengaging from the blade during use, although such safety members can be inadvertently disengaged. Accordingly, improvements to folding knives are desirable.

SUMMARY

In one embodiment of the present disclosure, a folding knife may comprise a handle, a blade pivotably coupled to the handle and operable to pivot between a closed position and an open position, a blade-locking member disposed in the handle and being moveable in a first direction between an unlocked position and a locked position to retain the blade in at least one of the open or closed positions and a safety member slidably mounted on the blade-locking member and being moveable in the first direction and a second direction perpendicular to the first direction. The safety member may be configured to block the blade-locking member from moving from the locked position to the unlocked position when the blade is in one of the open or closed positions.

In some embodiments, the safety member may be movable in the second direction between a release position and a safety position, wherein when the safety member is in the safety position, the safety member and the blade-locking member are blocked from moving in the first direction, and wherein when the safety member is in the release position, the safety member and the blade-locking member can be moved in the first direction to move the blade-locking member to the unlocked position. The folding knife may further comprise a first biasing member configured to resiliently urge the safety member to the safety position. The folding knife may further comprise a second biasing member configured to resiliently urge the blade-locking member to the locked position.

Additionally and/or alternatively, in some embodiments the blade-locking member may comprise a cross-bolt. Additionally and/or alternatively, the first direction may be parallel to a pivot axis of the blade. Additionally and/or alternatively, the handle may comprise a recessed portion and the safety member may be moveable in the first direction and in the second direction within the recessed portion. Additionally and/or alternatively, the safety member may comprise an elongated slot and the blade-locking member may comprise a projection disposed within the elongated slot such that the safety member may be moveable in the second direction relative to the projection. Additionally and/or alternatively, the blade-locking member and the safety member may be configured to be jointly operable by a user's thumb. Additionally and/or alternatively, the safety member may be disposed above a surface of the handle when the blade-locking member is in the locked position and may be disposed below or flush with the surface of the handle when the blade-locking member is in the unlocked position.

In some embodiments of the present disclosure, a method of using a folding knife may comprise moving a safety member with a thumb causing the safety member to move from a safety position to a release position, the safety member being moveably mounted to a blade-locking member disposed in a handle. The method may further comprise moving the blade-locking member with the thumb causing the blade-locking member to move from a locked position to an unlocked position while maintaining pressure on the safety member such that the safety member remains in the release position and pivoting the blade to move from one of an open position to a closed position or the closed position to the open position.

In some embodiments, moving the blade-locking member may comprise pressing the blade-locking member in a first direction towards the handle. Additionally and/or alternatively, moving the safety member may comprise sliding the safety member in a second direction perpendicular to the first direction. Additionally and/or alternatively, the safety member may contact an inner surface of the handle when the safety member is in the safety position so as to block the blade-locking member from being moved to the unlocked position. Additionally and/or alternatively, moving the safety member may further comprise compressing a biasing member of the safety member, the biasing member being configured to bias the safety member toward the safety position.

In some embodiments of the present disclosure, a folding knife may comprise a handle, a blade, the blade having a tang portion that is pivotably coupled to the handle and operable to pivot between a closed position and an open position and a blade-locking member disposed in the handle and being moveable in a first direction between an unlocked position and a locked position to retain the blade in at least one of the open or closed positions. The folding knife may further comprise a safety member mounted on the blade-locking member and being moveable relative thereto in a second direction between a release position and a safety position, wherein when the safety member is in the safety position, the safety member and the blade-locking member are blocked from moving in the first direction, and wherein when the safety member is in the release position, the safety member and the blade-locking member can be moved in the first direction to move the blade-locking member to the unlocked position.

In some embodiments, the folding knife may further comprise a biasing member configured to resiliently urge the safety member to the safety position. Additionally and/or alternatively, the first direction may be parallel to a pivot axis of the blade. Additionally and/or alternatively, the second direction may be perpendicular to the first direction. Additionally and/or alternatively, the blade-locking member may comprise a projection extending from a first end portion of the blade-locking member and the safety member may be slidably mounted on the projection.

DETAILED DESCRIPTION

Figures 1, 2, 3:
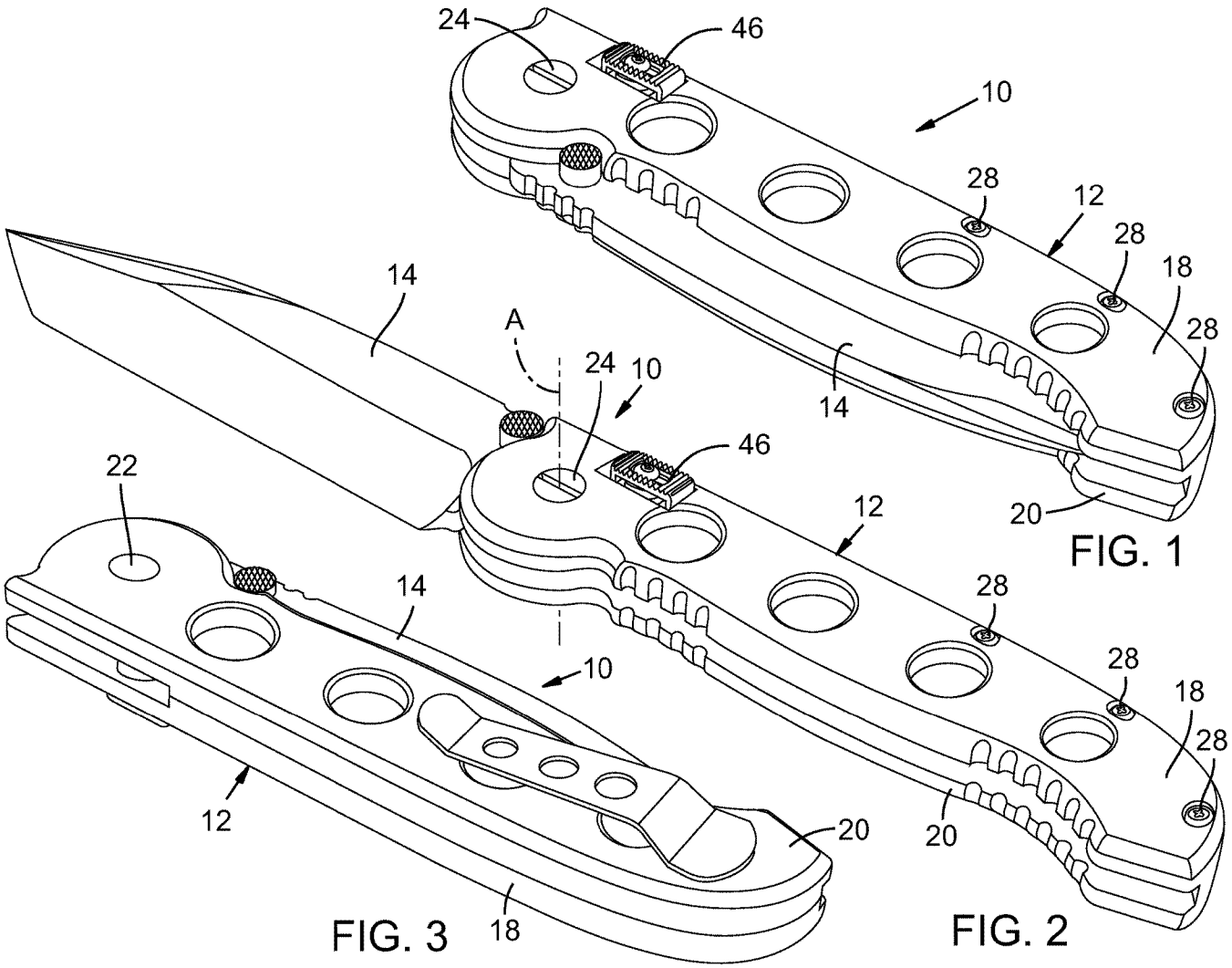
FIG. 1 is a perspective view of a folding knife showing the blade in a closed position, according to one embodiment.
FIG. 2 is a perspective view of the folding knife of FIG. 1 showing the blade in an open position.
FIG. 3 is another perspective view of the folding knife of FIG. 1 shown with the blade in the closed position.
Figure 4:
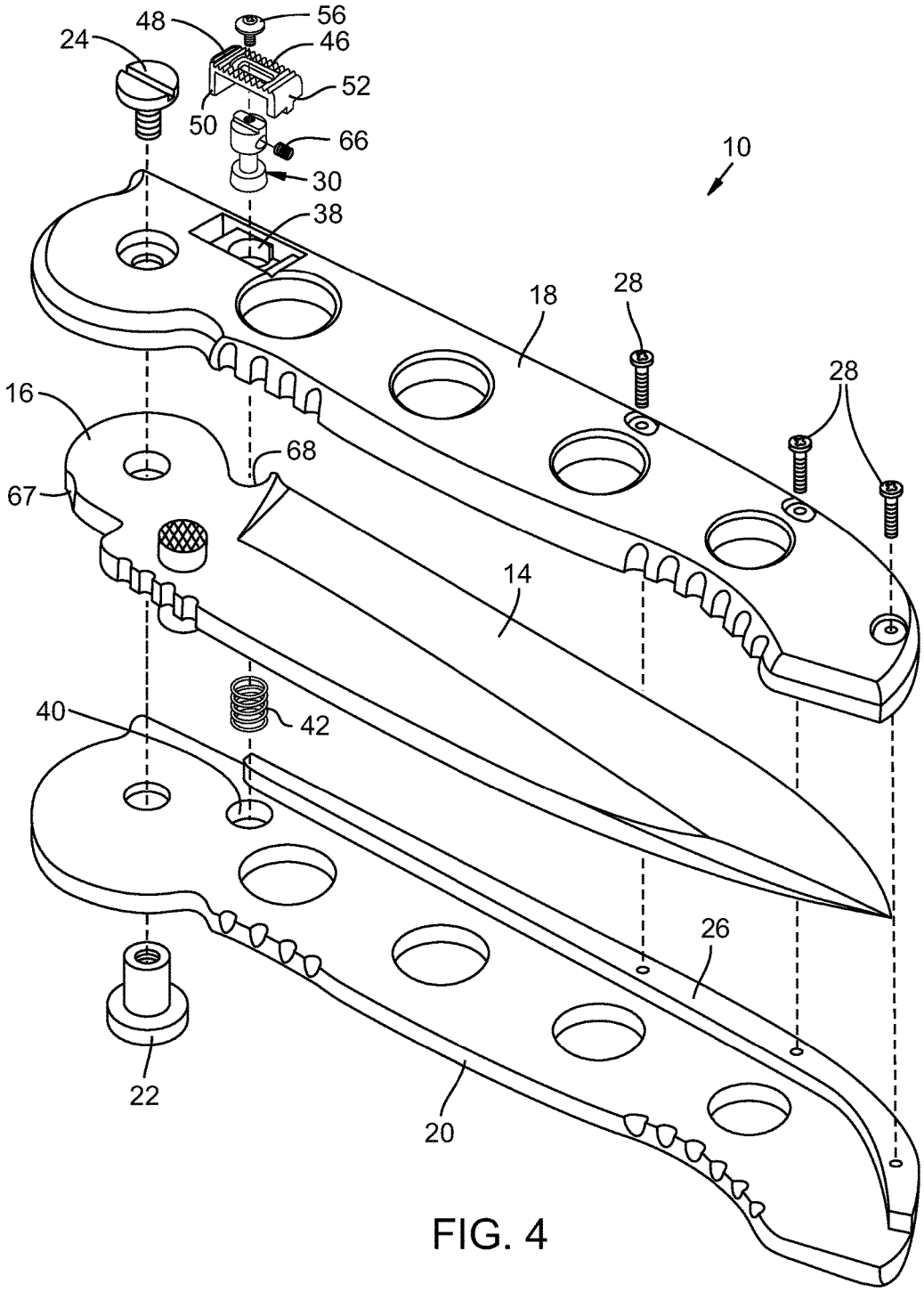
FIG. 4 is an exploded view of the folding knife of FIG. 1.

Referring to the figures, there is shown a folding knife 10, according to one embodiment. The knife 10 may comprise a handle 12 and a blade 14 pivotally coupled to the handle at a base or tang portion 16 of the blade 14. The handle 12 of the knife 10 may comprise a first half 18 (first handle or side portion) and a second half 20 (second handle or side portion) with the blade 14 disposed there-between. The blade 14 may be pivotable about a pivot axis A between a closed position and an open position. The closed position may include a folded position as shown in FIG. 1 and/or the open position may include a ready for use position, shown in FIG. 2.

The blade 14 may be connected to the handle 12 by a conventional pivot assembly comprising a pivot pin, or shaft, 22 and a screw 24. The pivot pin 22 may extend through corresponding openings in the second handle portion 20 and the blade tang 16. The screw 24 may extend through an opening in the first handle portion 18 and may be tightened into an internally threaded bore of the pivot pin 22. The handle 12 may further include a spacer or spline 26 disposed between the first and second handle portion 18, 20, respectively, all of which components may be secured to each other with a plurality of screws 28.

Figure 5A:
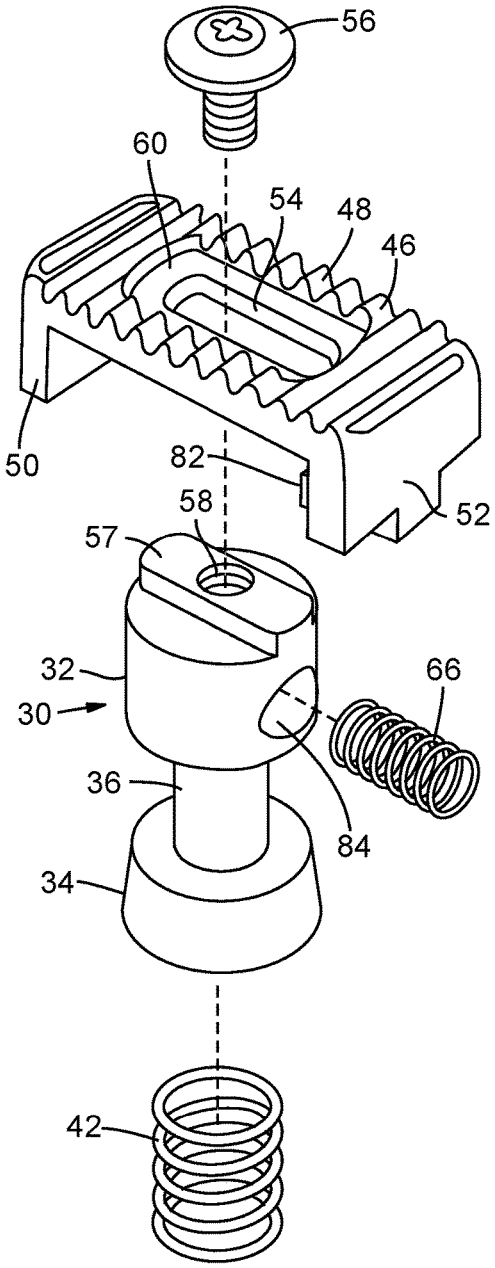
FIGS. 5A and 5B are exploded views of a safety member and a cross-bolt of the folding knife of FIG. 1.
Figure 5B:
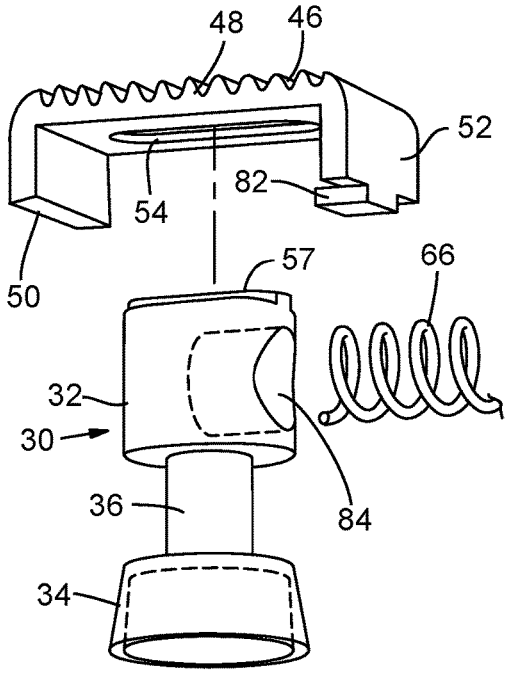
Figure 6A:
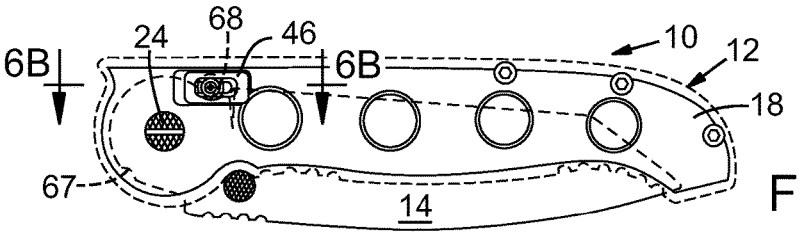
FIG. 6A is a side view of the folding knife of FIG. 1 showing the blade in the closed and locked position.
Figure 6B:
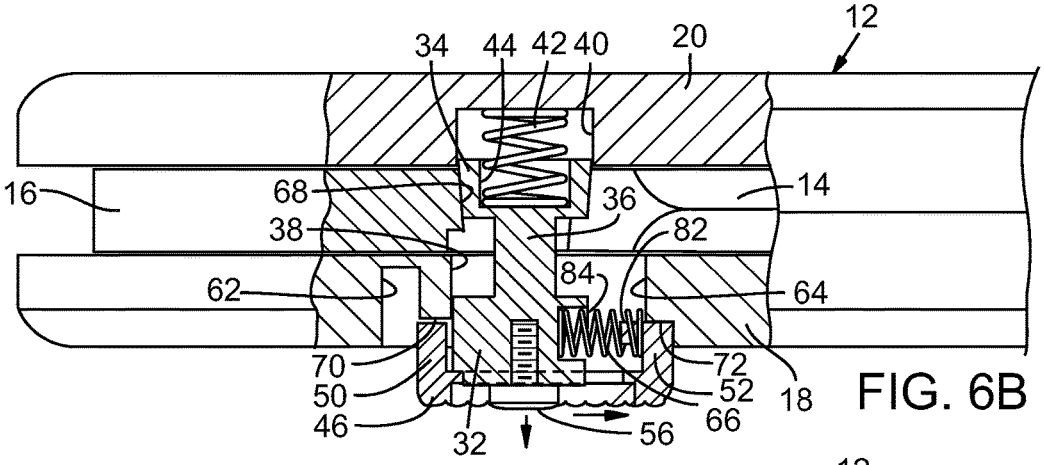
FIG. 6B is an enlarged cross-sectional view of the folding knife taken along line 6B-6B of FIG. 6A, showing the safety member in the safety position and the cross-bolt in the locked position.
Figure 6C:
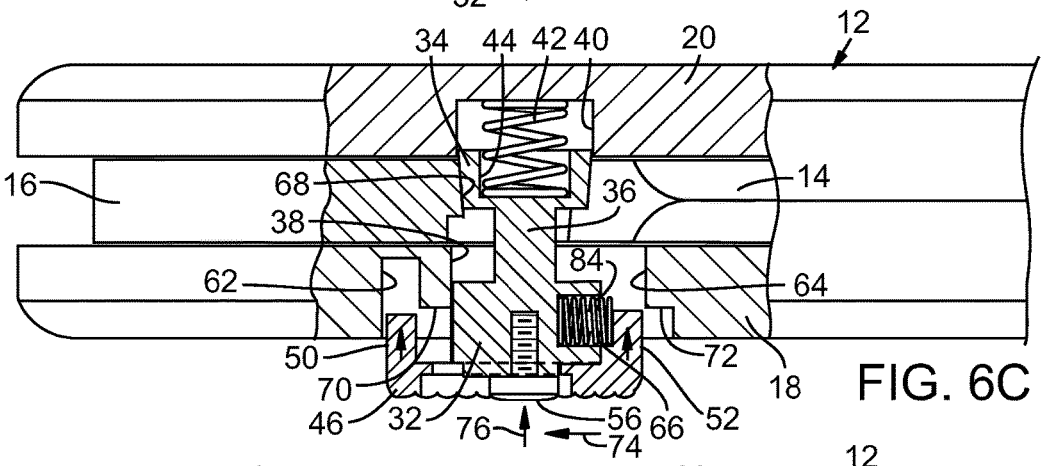
FIG. 6C is an enlarged cross-sectional view of the folding knife of FIG. 6A, showing the safety member in the release position and the cross-bolt in the locked position.
Figure 6D:
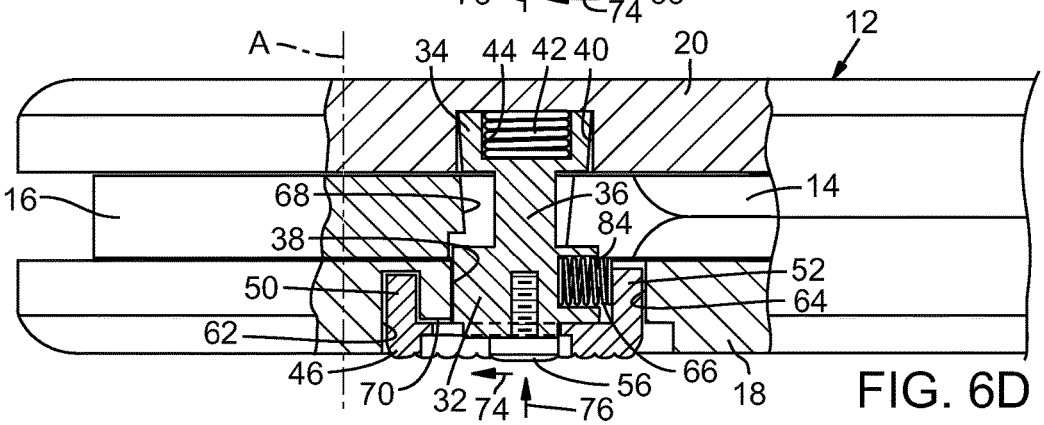
FIG. 6D is an enlarged cross-sectional view of the folding knife of FIG. 6A, showing the safety member in the release position and the cross-bolt in the unlocked position.

For example, in some embodiments, as best shown in FIGS. 5A-5B, the knife may include a blade-locking or latch member in the form of a cross-bolt 30, which may be configured to lock the blade in the open and/or closed position until activated by a user. The cross-bolt 30 may be referred to as a "button" lock since a user may actuate the cross-bolt 30 by pressing it like a button, as further described below. The cross-bolt 30 may comprise first and second enlarged end portions 32, 34, respectively, and a necked-down intermediate shaft portion 36. As best shown in FIGS. 6B-6D, the cross-bolt 30 may extend laterally (parallel to pivot axis A) through the handle 12 adjacent the tang 16 of the blade 14. The first end portion 32 may be moveable laterally (side-to-side) within an opening 38 in the first side portion 18 of the handle and the second end portion 34 may be moveable laterally within an opening or recess 40 in the second side portion 20 of the handle.

Figure 8:
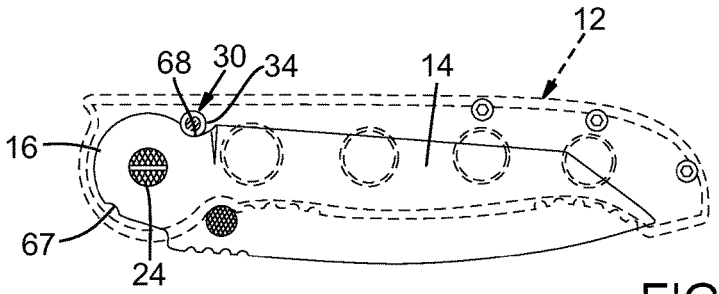
FIG. 8 is a side view of the folding knife of FIG. 1 showing the locked position of the cross-bolt relative to the blade when the blade is in the closed position.
Figure 9:
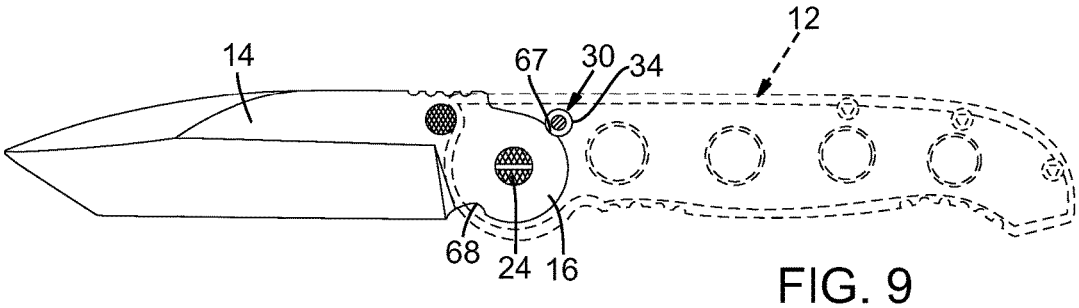
FIG. 9 is a side view of the folding knife of FIG. 1 showing the locked position of the cross-bolt relative to the blade when the blade is in the open position.

The cross-bolt 30 may be moveable laterally between a locked position (FIG. 6B) to block pivoting movement of the blade 14, and an unlocked position (FIG. 6D) to permit pivoting movement of the blade 14. When the blade 14 is in the closed position and the cross-bolt 30 is in the locked position, the second end portion 34 of the cross-bolt 30 may contact a notched surface 68 formed in the tang 16 (as best shown in FIGS. 6B and 8), thereby blocking pivoting movement of the blade away from the closed position. When the blade is in the open position and the cross-bolt is in the locked position, the second end portion 34 of the cross-bolt may contact another notched surface 67 formed in the tang 16 (FIGS. 7B and 9), thereby blocking pivoting movement of the blade 14 away from the open position. Pushing the cross-bolt 30 laterally toward the second side portion 20 of the handle may remove the second end portion 34 from contacting notched surfaces 67, 68 and may allow the blade to be pivoted open or closed.

The cross-bolt 30 may be biased toward the locked position by a biasing element, such as a spring 42. The spring 42 may be partially disposed in a laterally facing recess 44 formed in the second end portion 34 of the cross-bolt. One end of the spring 42 may bear against an adjacent surface within the recess 44 while the opposite end of the spring 42 may bear against an adjacent surface of the recess 40. In this manner, the spring 42 may bias the cross-bolt 30 toward the first side portion 18 of the handle 12 and/or to the locked position.

Some embodiments of the knife 10 may include a safety member 46 to retain the knife 10 in a desired position, namely one of the closed or open positions. As described above, the cross-bolt 30 may be actuated, for example by pressing it like a button, such that the second end portion 34 may be removed from contacting notched surfaces 67, 68, allowing the blade to be pivoted open or closed. The safety member 46 may provide an additional step for disengagement of the cross-bolt 30 from the contacting the tang 16 and/or notched surfaces 67, 68. The likelihood of inadvertent deactivation of the cross-bolt 30 may be reduced, at least in part because of the at least one additional step required by the safety member 46.

Referring again to FIGS. 5A-5B, the knife 10 may further include the safety member 46, which may be mounted on or coupled to the first end portion 32 of the cross-bolt 30. The safety member may be configured to block movement of the cross-bolt 30 to the unlocked position. The safety member 46 may include a user-engageable base 48 and first and second legs 50, 52, respectively, extending laterally from opposite ends of the base 48. The base 48 may be formed with an elongated slot or opening 54. The slot 54 may be configured to receive an oblong projection 57 extending from the first end portion 32 of the cross-bolt 30. The safety member 46 may be connected to the cross-bolt 30. For example, the safety member 46 may be connected to the first end portion 32 of the cross-bolt 30 by a screw 56 that extends into a threaded opening 58 formed in the first end portion 32. The head of screw 56 may be sized such that it does not extend beyond the outer surface of safety member 46. For example, the head of the screw 56 may reside in a recessed portion 60 formed in the base 48 such that the head of the screw 56 does not extend laterally beyond the outer surface of the base 48 (FIG. 6B). The safety member 46 may be moveable relative to the cross-bolt 30 between a first, safety position to block movement of the cross-bolt 30 and a second, release position to permit movement of the cross-bolt 30. For example, the safety member 46 may be slidable longitudinally (in the direction of the length of the handle and/or perpendicular to the pivot axis A) relative to the cross-bolt 30 between a first, safety position (FIG. 6B) to block movement of the cross-bolt 30 and a second, release position (FIG. 6D) to permit movement of the cross-bolt 30, as further explained below.

As best shown in FIG. 6B, the first side portion 18 of the handle 12 may be configured to permit movement of safety member 46. For example the first side portion 18 may be formed with a recessed portion 62 sized and shaped to receive the first leg 50 of the safety member 46 and a further recessed portion 64 sized and shaped to receive the second leg 52 of the safety member 46 when the safety member is moved to the release position. As shown, the recessed portion 64 may be part of the larger opening 38 that receives the first end portion 32 of the cross-bolt 30.

The safety member 46 may be biased to the safety position and/or blocking movement of cross-bolt 30. A biasing element, such as a spring 66, may be configured to the bias the safety member 46 to the safety position (FIG. 6B). The spring 66 may be disposed inside of the safety member such that one end portion of the spring 66 extends co-axially over a lip 82 connected to the leg 52 and the opposite end portion of the spring 66 extends into an opening 84 in the first end portion 32 of the cross-bolt 30. In this manner, one end of the spring 66 may bear against an adjacent surface of the second leg 52 and the opposite end of the spring may bear against an adjacent surface within the opening 84 of the first end portion 32 of the cross-bolt 30.

Referring to FIGS. 6A-6D, operation of the safety member 46 and the cross-bolt 30 to open the blade will now be described. In the closed and locked position (FIG. 6B), the second end portion 34 of the cross-bolt 30 may contact and/or may be in close proximity to the notched surface 68 of the blade tang 16 such that the cross-bolt blocks movement of the blade 14 from the closed position to the open position. The safety member 46 may be resiliently retained in the safety position by the spring 66 such that the legs 50, 52 of the safety member may be aligned with and/or in close proximity to (and/or in contact with) raised surfaces 70, 72, respectively, formed in the first side portion 18 of the handle 12. In this position, the legs 50, 52 may contact the raised surfaces 70, 72, thereby blocking lateral movement of the cross-bolt 30 away from the locked position.

The safety member 46 may be moveable from the safety position to the release position. While the safety member 46 is in the release position, the cross-bolt 30 may be moveable from the locked position to the unlocked position. For example, the safety member 46 can be moved from the safety position (shown in FIG. 6B) to the release position (shown in FIG. 6C) by applying sufficient manual pressure to the base 48 to overcome the bias of the spring 66 so as to slide the safety member 46 in the direction of arrow 74 until the legs 50, 52 are moved away from the raised surfaces 70, 72 and are aligned with the recessed portions 62, 64. While maintaining manual pressure on the safety member (against the bias of the spring 66), the cross-bolt 30 can be depressed inwardly in the direction of arrow 76 against the bias of spring 42 so as to move the cross-bolt 30 to the unlocked position.

As shown in FIG. 6D, the recessed portions 62, 64 may be deep enough to permit sufficient lateral movement of the legs 50, 52 and the cross-bolt 30 until the first end portion 32 may be received in the opening 38 in the first side portion 18 of the handle 12 and the second end portion 34 is fully received in the opening 40 in the second side portion 20 of the handle 12 and no longer in the path of travel of the blade 14. In this position, the blade 14 can be pivoted from the closed position to the open position. As can be appreciated, the safety member 46 and the cross-bolt 30 can be activated using a single digit of the hand (e.g., the thumb) by first sliding the safety member 46 in a first direction to the release position (FIG. 6C) and then pushing the safety member 46 and the cross-bolt 30 in a second direction to move the cross-bolt 30 to the unlocked position (FIG. 6D).

In particular embodiments, the knife 10 can be a so-called automatic knife having a spring or another biasing member (e.g., a torsion spring) that forces the blade 14 to the move from the closed position to the fully open position (FIG. 2) when the cross-bolt 30 is moved to the unlocked position shown in FIG. 6D. Details of a spring that can be implemented in the knife 10 to provide the opening force to the blade are provided in U.S. Pat. No. 8,375,589, which is incorporated herein by reference.

Figure 7A:
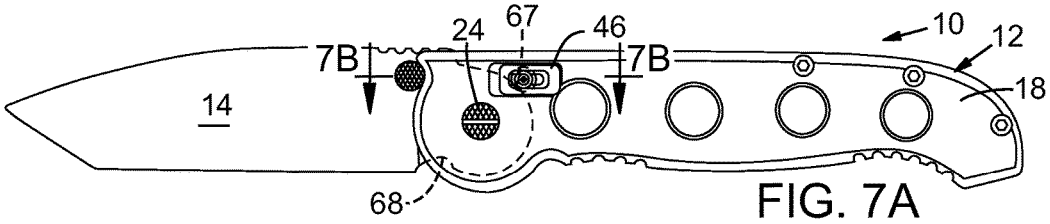
FIG. 7A is a side view of the folding knife of FIG. 1 showing the blade in the open and locked position.
Figure 7B:
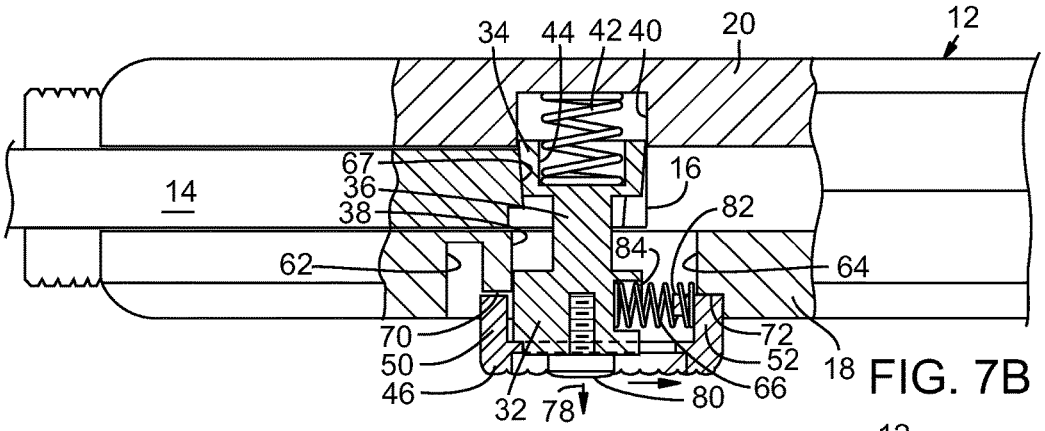
FIG. 7B is an enlarged cross-sectional view of the folding knife taken along line 7B-7B of FIG. 7A, showing the safety member in the safety position and the cross-bolt in the locked position.
Figure 7C:
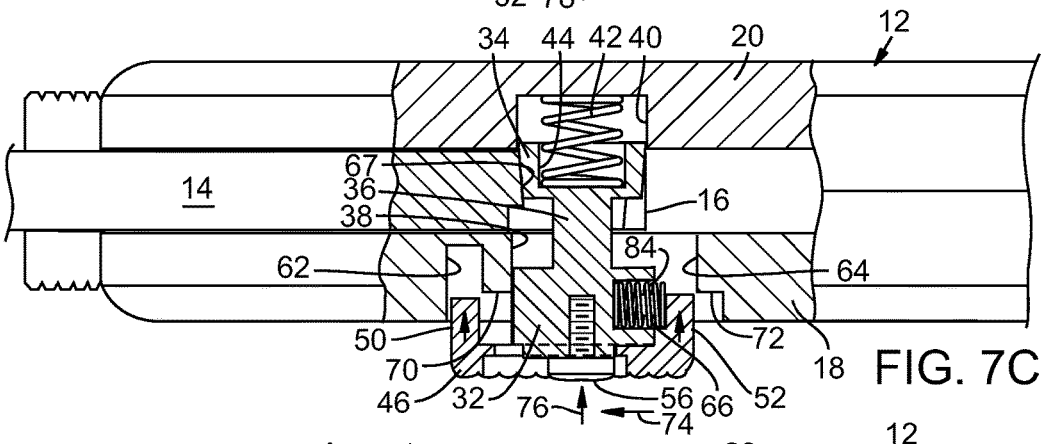
FIG. 7C is an enlarged cross-sectional view of the folding knife of FIG. 7A, showing the safety member in the release position and the cross-bolt in the locked position.
Figure 7D:
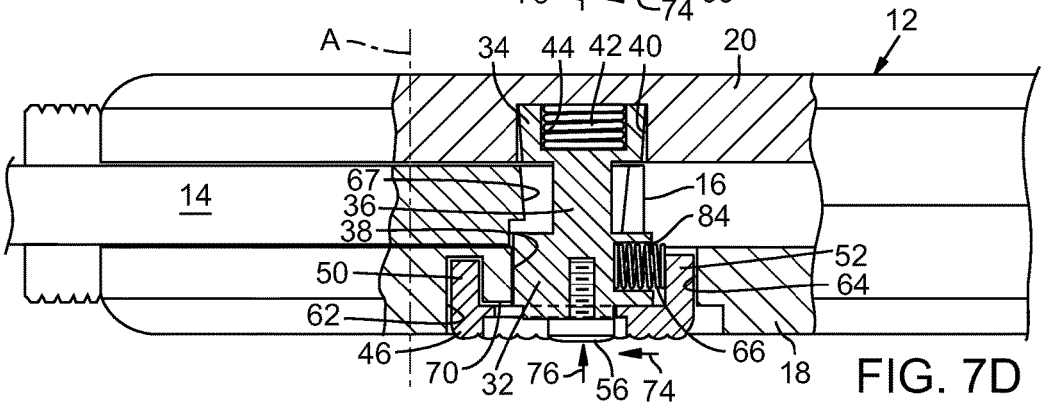
FIG. 7D is an enlarged cross-sectional view of the folding knife of FIG. 7A, showing the safety member in the release position and the cross-bolt in the unlocked position.

When the blade 14 has reached the fully open position (FIG. 7A), manual pressure can be released from the safety member 46, allowing the spring 42 to move the cross-bolt 30 in the direction of arrow 78 back to the locked position and allowing the spring 66 to move the safety member 46 in the direction of arrow 80 to the safety position (FIG. 7B). In this position, the second end portion 34 of the cross-bolt 30 may block the path of travel of the blade 14 and the legs 50, 52 may again be aligned with the raised surface portions 70, 72 in the first side portion 18 of the handle, thereby blocking inward lateral movement of the safety member 46 and the cross-bolt 30. To permit closing of the blade, manual pressure can be applied to the safety member 46 to first move the safety member in the direction of arrow 74 to the release position (FIG. 7C), and then to move the cross-bolt 30 in the direction of arrow 76 to the unlocked position (FIG. 7D). In this position, the second end portion 34 may be fully received in the opening 40 and/or may no longer blocks the path of travel of the blade.

In other embodiments, the knife 10 can be a so-called assisted-opening knife having a spring or other biasing member that a provides biasing force that retains the blade in the closed position and then provides an opening force to the blade to assist in opening the blade after the blade has been manually pivoted from the closed position to a partially open position. Spring configurations for assisted-opening knives are disclosed in U.S. Pat. No. 6,834,432 and U.S. Pat. No. 6,145,202, which are incorporated herein by reference. Desirably, although not necessarily, when the knife 10 is an assisted-opening knife, the blade-latching member (e.g., a cross-bolt) is configured to engage and lock the blade in the open position but not the closed position. Thus, in such cases, the user need not move the safety member to the release position in order to open the blade. Similarly, when the knife 10 comprises a manually-opened knife (a knife without any spring or other biasing element that exerts an opening force on the blade), the blade-latching member (e.g., a cross-bolt) can be configured to engage and lock the blade in the open position but not the closed position such that the user need not move the safety member to the release position in order to open the blade. In other embodiments of assisted-opening knives or manually-opened knives, the blade-latching member (e.g., a cross-bolt) can be configured to engage and lock the blade in the open position and the closed position such that the user moves the safety member to the release position in order to open the blade, as described in detail above.

The safety member 46 can also be implemented in folding knives having other types of blade-latching members, and in particular any type of blade-latching member that is moved from an unlocked position to a locked position by depressing the blade-latching member to move it in the direction of its longitudinal axis. For example, co-pending U.S. application Ser. No. 14/855,179, filed Sep. 15, 2015, which is incorporated herein by reference, discloses a folding knife having a blade-locking member that is moved from a locked position to an unlocked position by pushing the blade-locking member laterally into the handle (perpendicular to the length of knife and parallel to the pivot pin) similar to the cross-bolt 30. Such a knife can include the safety member 46 to prevent inadvertent movement of the blade-locking member.

In alternative embodiments, the safety member 46 can be implemented in a folding knife having a liner lock or frame lock. As known in the art, a liner lock or frame lock comprises a laterally moveable leaf spring formed in a liner or frame of the handle that is biased to move to a locked positioned behind the blade tang, typically when the blade is in the open position. The safety member can be, for example, mounted on the leaf spring for movement between a safety position that blocks lateral movement of the leaf spring and a release position that allows lateral movement of the leaf spring away from blade tang to permit pivoting movement of the blade.

For purposes of this description, certain aspects, advantages, and novel features of the embodiments of this disclosure are described herein. The disclosed methods, devices, and systems should not be construed as limiting in any way. Instead, the present disclosure is directed toward all novel and nonobvious features and aspects of the various disclosed embodiments, alone and in various combinations and subcombinations with one another. The methods, devices, and systems are not limited to any specific aspect or feature or combination thereof, nor do the disclosed embodiments require that any one or more specific advantages be present or problems be solved.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. As used herein, the terms "a", "an", and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A", "B", "C", "A and B", "A and C", "B and C", or "A, B, and C."

As used herein, the term "coupled" generally means physically coupled or linked and does not exclude the presence of intermediate elements between the coupled items absent specific contrary language.

In the description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A folding knife comprising:

a handle;

a blade pivotably coupled to the handle and operable to pivot between a closed position and an open position;

a blade-locking member disposed in the handle and being moveable in first and second opposing directions along a first axis between an unlocked position disengaged from the blade and a locked position engaging the blade to retain the blade in at least one of the open or closed positions; and a safety member coupled to the handle and mounted on the blade-locking member and being moveable with the blade-locking member along the first axis and movable relative to the blade-locking member in third and fourth opposing directions along a second axis that is perpendicular to the first axis;

wherein the safety member is configured to block the blade-locking member from moving from the locked position to the unlocked position when the blade is in one of the open or closed positions.

2. The folding knife of claim 1, wherein the safety member is movable in the third and fourth directions between a release position and a safety position, wherein when the safety member is in the safety position, the safety member and the blade-locking member are blocked from moving in the first direction, and wherein when the safety member is in the release position, the safety member and the blade-locking member can be moved in the first direction to move the blade-locking member to the unlocked position.

3. The folding knife of claim 2, further comprising a first biasing member coupled to a portion of the safety member and a portion of the blade-locking member, the first biasing member being configured to resiliently urge the safety member to the safety position.

4. The folding knife of claim 3, further comprising a second biasing member coupled to a portion of the blade-locking member and a portion of the handle, the second biasing member being configured to resiliently urge the blade-locking member to the locked position.

5. The folding knife of claim 1, wherein the blade-locking member comprises a cross-bolt.

6. The folding knife of claim 5, wherein the first and second directions are parallel to a pivot axis of the blade, the pivot axis being defined by the pivotal coupling.

7. The folding knife of claim 5, further comprising a first biasing member coupled to a portion of the safety member and a portion of the cross-bolt, the first biasing member being configured to resiliently urge the safety member to the safety position and a second biasing member coupled to a portion of the cross-bolt and a portion of the handle, the second biasing member being configured to resiliently urge the cross-bolt to the locked position.

8. The folding knife of claim 5, wherein the handle comprises a recessed portion defining the coupling between the safety member and the handle and the safety member is moveable in the first direction and in the second direction within the recessed portion.

9. The folding knife of claim 1, wherein the first and second directions are parallel to a pivot axis of the blade, the pivot axis being defined by the pivotal coupling of the blade.

10. The folding knife of claim 1, wherein the handle comprises a recessed portion defining the coupling between the safety member and the handle, and the safety member is moveable in the first direction and in the second direction within the recessed portion.

11. The folding knife of claim 1, wherein the safety member comprises an elongated slot and the blade-locking member comprises a projection disposed within the elongated slot such that the safety member is moveable in the third and fourth directions relative to the projection, wherein the safety member is slidably mounted on the blade-locking member via the projection and the elongated slot.

12. The folding knife of claim 1, wherein the blade-locking member and the safety member are configured to be jointly operable by a user's thumb.

13. The folding knife of claim 1, wherein the safety member is disposed above a surface of the handle when the blade-locking member is in the locked position and is disposed below or flush with the surface of the handle when the blade-locking member is in the unlocked position.

14. A method of using the folding knife of claim 1, comprising:

moving the safety member with a thumb causing the safety member to move along the second axis from a safety position to a release position;

moving the blade-locking member with the thumb causing the blade-locking member to move from the locked position to the unlocked position while maintaining pressure on the safety member such that the safety member remains in the release position; and pivoting the blade to move from one of an open position to a closed position or the closed position to the open position.

15. The method of claim 14, wherein moving the blade-locking member comprises pressing the blade-locking member in the first direction towards the handle.

16. The method of claim 15, wherein moving the safety member comprises sliding the safety member in the third direction.

17. The method of claim 14, wherein the safety member contacts an inner surface of the handle when the safety member is in the safety position so as to block the blade-locking member from being moved to the unlocked position.

18. The method of claim 14, wherein moving the safety member further comprises compressing a biasing member, the biasing member being configured to bias the safety member toward the safety position.

19. A folding knife comprising:

a handle;

a blade, the blade having a tang portion that is pivotably coupled to the handle and operable to pivot between a closed position and an open position;

a blade-locking member disposed in the handle and being moveable in first and second opposing directions between an unlocked position disengaged from the blade and a locked position engaging the blade to retain the blade in at least one of the open or closed positions; and a safety member coupled to the handle and mounted on the blade-locking member and being moveable relative thereto in third and fourth opposing directions between a release position and a safety position, wherein when the safety member is in the safety position, the safety member and the blade-locking member are blocked from moving in the first direction, and wherein when the safety member is in the release position, the safety member and the blade-locking member can be moved in the first direction to move the blade-locking member to the unlocked position.

20. The folding knife of claim 19, further comprising a biasing member coupled to a portion of the safety member and a portion of the blade-locking member, the biasing member being configured to resiliently urge the safety member to the safety position.

21. The folding knife of claim 19, wherein the first and second directions are parallel to a pivot axis of the blade, the pivot axis being defined by the pivotal coupling.

22. The folding knife of claim 21, wherein the third and fourth directions are perpendicular to the first and second directions.

23. The folding knife of claim 19, wherein the blade-locking member comprises a projection extending from a first end portion of the blade-locking member and the safety member is slidably mounted on the projection, wherein the safety member is mounted on the blade-locking member for movement relative thereto via the projection and the safety member slidably mounted on the projection.

24. A folding knife comprising:

a handle;

a blade pivotably coupled to the handle and operable to pivot between a closed position and an open position about a pivot axis;

a blade-locking member disposed in the handle and being moveable in first and second opposing directions along a first axis between an unlocked position disengaged from the blade and a locked position engaging the blade to retain the blade in at least one of the open or closed positions, wherein the blade-locking member comprises a cross-bolt, and the first axis is parallel to the pivot axis of the blade;

a safety member coupled to the handle and mounted on the blade-locking member and being moveable in the first and second directions with the blade-locking member along the first axis and moveable relative to the blade-locking member in third and fourth opposing directions along a second axis perpendicular to the first axis, wherein the safety member is movable in the third and fourth directions between a release position and a safety position, wherein when the safety member is in the safety position, the safety member and the blade-locking member are blocked from moving in the first direction, and wherein when the safety member is in the release position, the safety member and the blade-locking member can be moved in the first direction to move the blade-locking member to the unlocked position; and a first biasing member coupled to a portion of the safety member and a portion of the blade-locking member, the first biasing member being configured to resiliently urge the safety member to the safety position, and a second biasing member coupled to a portion of the blade-locking member and a portion of the handle, the second biasing member being configured to resiliently urge the blade-locking member to the locked position;

wherein the handle comprises a recessed portion defining the coupling between the safety member and the handle and the safety member is moveable in the first and second directions and in the third and fourth directions within the recessed portion;

wherein the safety member comprises an elongated slot and the blade-locking member comprises a projection disposed within the elongated slot such that the safety member is moveable in the third and fourth directions relative to the projection, wherein the safety member is slidably mounted on the blade-locking member via the projection and the elongated slot;

wherein the blade-locking member and the safety member are configured to be jointly operable by a user's finger;

wherein the safety member is disposed above a surface of the handle when the blade-locking member is in the locked position and is disposed below or flush with the surface of the handle when the blade-locking member is in the unlocked position.

* * * * *